United States Patent [19]

Rydell

[11] 4,281,501

[45] Aug. 4, 1981

[54] FINGER MOUNTING APPARATUS FOR LOADING GRID

[76] Inventor: Adam Z. Rydell, 3742 Tree Bark Trail, Decatur, Ga. 30034

[21] Appl. No.: 76,345

[22] Filed: Sep. 17, 1979

[51] Int. Cl.[3] ..... B65B 39/02; B65B 5/08

[52] U.S. Cl. ..... 53/248; 53/261

[58] Field of Search ..... 53/248, 262, 261, 260, 53/247

[56] References Cited

U.S. PATENT DOCUMENTS

| | | | |
|---|---|---|---|
| 4,044,530 | 8/1977 | Phillips | 53/248 |
| 4,075,819 | 2/1978 | Raudat et al. | 53/262 X |
| 4,171,603 | 10/1979 | Wiseman | 53/248 |
| 4,207,721 | 7/1980 | Raudat et al. | 53/248 |
| 4,207,722 | 7/1980 | Raudat | 53/248 |

*Primary Examiner*—Horace M. Culver

*Attorney, Agent, or Firm*—James B. Middleton

[57] ABSTRACT

Finger mounting apparatus for a case loading grid is disclosed. Pyramidal shaped blocks are fixed to conventional bars in a packing grid, and a plate is selectively fixed to the bottom face of a block. The plate has an opening to hold a finger. The same block can mount two or more types of plate to carry two or more different types of finger. A single plate can be removed from a grid without removing the entire grid, so the grid can be serviced without removing the entire grid.

12 Claims, 7 Drawing Figures

FINGER MOUNTING APPARATUS FOR LOADING GRID

FIELD OF THE INVENTION

This invention relates generally to case loading apparatus, and is more particularly concerned with means for holding fingers in a case loading grid.

BACKGROUND OF THE INVENTION

For a number of years, grids have been used in the loading of bottles and other containers into cases wherein the cases are divided by a plurality of partitions so that a discrete section is designed to receive one container. Conventionally, there is a plurality of bars extending parallel to one another and aligned with the direction of movement of the containers to be loaded into the cases. The bars are so spaced as to provide a bar over each of the partitions in the cases to be loaded. Thus, the conventional arrangement is that a plurality of containers to be loaded into the cases are urged by the conveyor means between the plurality of bars, and the bottles are held until the entire grid is loaded. At a predetermined time, the bottles are allowed to fall simultaneously, and fingers carried by the bars assist in directing the bottles into the sections of the case waiting below.

While the parallel bars separate the bottles in one direction, and the bars are aligned with the partitions extending in one direction across the case, there is no means for assuring that the bottles are properly spaced in the opposite direction, i.e., in the direction of movement. While the fingers carried by the parallel bars are designed to direct the individual bottles into the sections of the case, the means for holding these fingers to the bars have caused a number of difficulties. The finger mounting means normally has a relatively large flat area on the top thereof so that a bottle can hit the top of the finger mounting means and fail to drop at all, or drop in an improper location such as on one of the partitions of the case. Further, the pivots, spring returns and the like in the conventional finger mounting means are open so that debris can easily fall into the mechanism and jam the operation of the finger. It will be understood that bottles occasionally break in these packing grids, and that pieces of glass can easily lodge in the mechanism and cause improper operation. Further, when there is any problem with any one of the fingers, or mounting means, in conventional packing grids the entire grid must be removed for repair, and a new grid installed in order to continue operation. This is extremely time consuming, and expensive both from the standpoint of labor involved, and from the standpoint of down-time for the packing line.

SUMMARY OF THE INVENTION

The present invention overcomes the above mentioned and other difficulties with the prior art case loading grids by providing a plurality of blocks receivable on the bars, the blocks being appropriately spaced to be generally above the intersections of the partitions in the case to be loaded, and a plate removeably receivable on each block, the plate being of the same general shape as the bottom surface of the block. The plate is provided with an opening to receive a finger, and a slot intersects the opening to receive a pin for mounting the finger. The present invention includes two or more plates selectively receivable on the same block for mounting two different types of finger so that the blocks can remain in place while the plates are removed to allow changing of fingers or the like. The invention further includes one finger for operation at the corner of a section of a case, the finger being pivotal with respect to said plate and having a spring acting against the bottom surface of said block for moving the finger to the closed position. The invention also includes a spring finger having the upper end thereof cut at a predetermined angle, the plate being arranged to hold the finger against the lower side of the block to determine the angle of the finger with respect to the case.

These and other features and advantages of the present invention will become apparent from consideration of the following specification when taken in conjunction with the accompanying drawings in which.

DESCRIPTION OF THE PREFERRED EMBODIMENT

Figures 1, 2, 3, 4, 5, 6, 7:
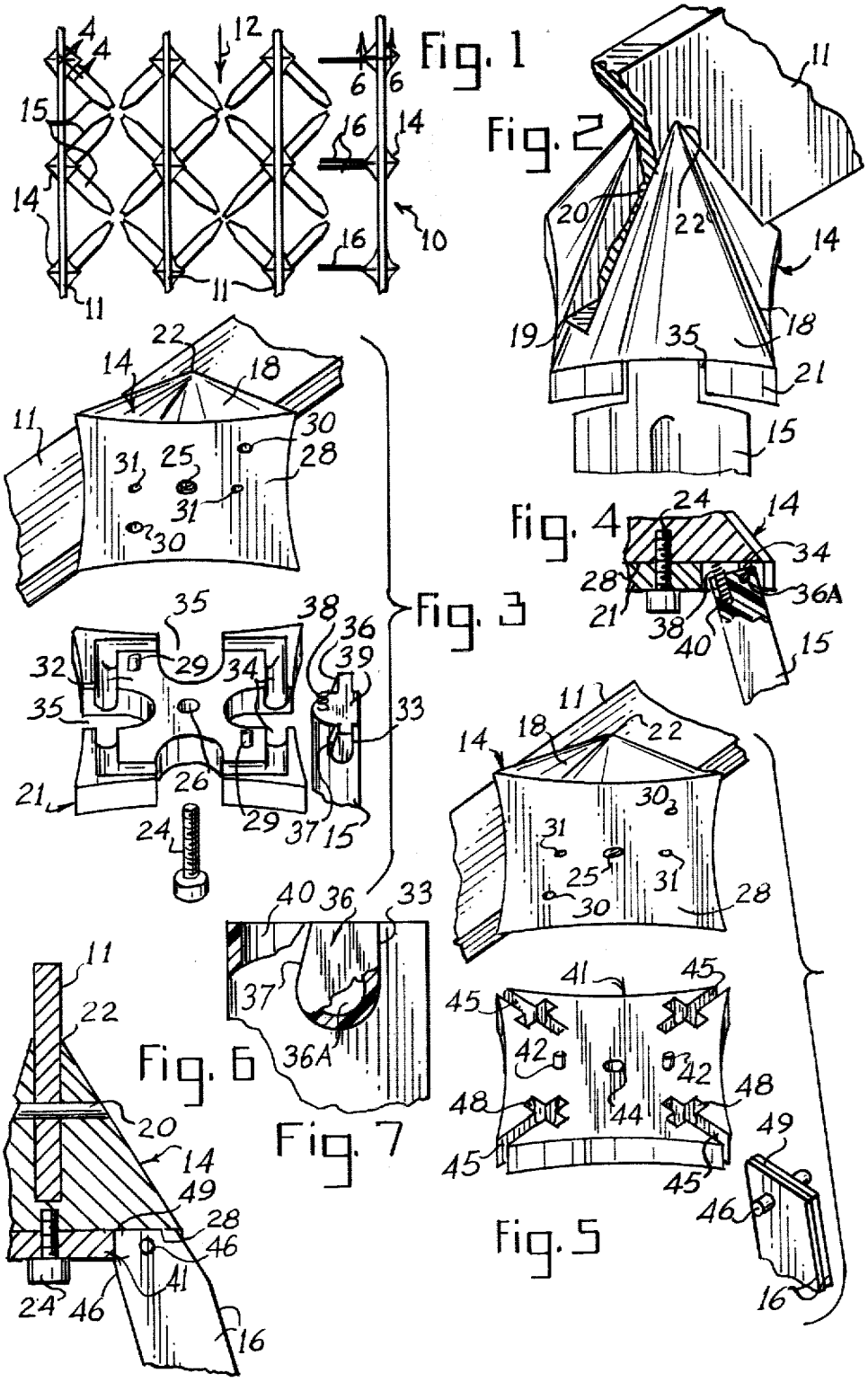
FIG. 1 is a top plan view of a case loading grid having finger mounting means made in accordance with the present invention carried thereby, and further showing two different forms of finger in the same grid for purposes of illustration.
FIG. 2 is a perspective view of a finger mounting means as shown in FIG. 1, the bar carrying the mounting means being partially broken away for clarity.
FIG. 3 is an exploded view showing the apparatus as in FIG. 2.
FIG. 4 is a cross-sectional view, on an enlarged scale, taken substantially along the line 4—4 in FIG. 1.
FIG. 5 is a view similar to FIG. 3, but showing a different form of plate and different fingers to be carried by the plate.
FIG. 6 is a cross-sectional view, on an enlarged scale, taken substantially along the line 6—6 in FIG. 1; and, FIG. 7 is an enlarged, fragmentary side elevational view of one form of finger made in accordance with the present invention.

Referring now more particularly to the drawings, and to that embodiment of the invention here chosen by way of illustration, FIG. 1 shows a grid generally designated at 10 having a plurality of longitudinally disposed, laterally spaced, bars 11. It will be understood by those skilled in the art that the direction of movement of bottles to be loaded into cases is as shown by the arrow 12. The conveying means for carrying the bottles, and the other conveying means for transporting the cases to be loaded, are omitted since they form no part of the present invention, and those skilled in the art will be sufficiently familiar with the usual environment for the grid 10.

Disposed along each of the bars 11, there is a plurality of blocks 14, and it will be seen that all of the blocks 14 in the grid 10 are substantially identical.

Looking at the left-hand side of the drawing in FIG. 1, it will be seen that the blocks 14 carry fingers 15, the fingers 15 being of the form to operate in the corners of the sections of a case. It will be understood that, before a bottle is passed through the grid 10, the fingers 15 move to their closed position wherein the lower ends of the fingers 15 are closely adjacent to one another. When a bottle is dropped through the grid, the fingers 15 are urged rearwardly, generally against some form of spring tension, to their open position. This will be discussed in more detail hereinafter.

Looking at the right-hand side of the drawing in FIG. 1, it will be seen that the blocks 14 carry fingers 16, the fingers 16 being flat blades, conventionally of a spring steel. It will also be seen that some of the blocks 14 have two of the fingers 16 extending from one corner thereof. This is because one finger 16 should be placed on each side of a partition in a case to be loaded.

While an arrangement precisely like that shown in FIG. 1 of the drawings may not be used, the purpose of the illustration is to show that the same blocks 14 are capable of mounting either fingers such as the fingers 15 or fingers such as the fingers 16. As a result, some of the fingers in a single grid 10 may in fact be fingers 16, and others may be fingers 15 depending on the particular problems to be solved at the time.

Referring now specifically to FIG. 2 of the drawings, it will be seen that the block 14 has a somewhat pyramidal shape but with concave faces 18. Generally along one diagonal of the pyramid shaped block 14, there is a slot 19 appropriately sized to receive the bar 11.

While many fastening means may be devised to attach the block 14 to the bar 11, there is here shown a pin 20 extending transversely through the bar 11 and through an appropriate hole in the block 14. It will be realized that the pin 20 can be appropriately swaged or the like at each end, or the pin can be a press fit, or other well known expedients may be used to assure that the pin 20 remains in place as long as desired. The advantages of using a pin such as the pin 20 is that the block 14 can be rather easily removed when desired. Otherwise, it will readily be understood that the block 14 can be welded or otherwise permanently affixed to the bar 11.

A plate 21 is fixed to the underside of the block 14, and in FIG. 2 a finger 15 is carried by the apparatus. It will be seen in FIG. 2 that the block 14 provides no flat area on its upper surfaces to receive a bottle, so the block 14 cannot cause a hang-up in the grid. The apex 22 of the block 14 is almost a point, and merges smoothly into the bar 11 so that a bottle hitting the point 22 would be inclined to move either to one face or the other and be directed to one of the sections of the case.

Looking at FIG. 3 of the drawings, it will be seen that the plate 21 is separable from the block 14, the plate 21 being held to the block 14 by a centrally located screw 24 which is receivable in a central threaded aperture 25 in the block 14. The screw 24 will pass through an opening 26 in the plate 21 and enter the threaded aperture 25 to secure the plate 21 to the underside, or bottom face, 28 of the block 14.

To assure proper alignment of the plate 21 with the face 28 of the block 14, there are here shown two alignment pins 29 which are receivable in holes 30 of the face 28 of the block 14. It will be seen that there are other holes 31 in the face 28, but the holes 31 are so placed that the two pins 29 cannot enter therein. As a result, the plate 21 will be received against the face 28 only with proper alignment, and the pins 29 will be received within the holes 30.

The upper surface 32 of the plate 21 has slots 34 therein. The slots 34 are here shown as connecting at the corners, though it will be understood by those skilled in the art that the slots 34 may be terminated before joining the adjacent slots 34.

Generally centrally of each of the sides of the plate 21, there is an opening 35 for receipt of a finger 15. The openings 35 are of sufficient size to allow easy movement of the finger 15 therein, and the slots 34 intersect the openings 35. It will be seen in FIG. 3 that the upper end of a finger 15 is depicted, the finger 15 having a pivot pin 36, and a spring 38 extends from the upper surface 39 of the finger 15.

While only one finger 15 is here shown for purposes of clarity, it will be understood that a finger 15 may be placed in each of the openings 35 in the plate 21, and each of the fingers 15 would be provided with an appropriate pin 36 to be received within the slots 34 adjacent to each of the openings 35.

For a better understanding of the total assembly of the apparatus shown in FIG. 3, attention is directed to FIG. 4 of the drawing which is a cross-sectional view of the device shown in FIG. 3, but assembled. It will here be seen that the plate 21 is held against the face 28 of the block 14 by means of the screw 24. The opening 35 in the plate 21 receives a finger 15, the pivot pin 36 being received in the slot 34. It will also be seen that the spring 38 is rearward of the pivot pin 36 and bears against the bottom face 28 of the block 14 to cause the finger 15 to pivot in a counter-clockwise direction as viewed in FIG. 4.

As is more clearly shown in FIGS. 4 and 7 of the drawings, the spring 38 is received within a hole 40 in the finger 15. The spring 38 is designed to pivot the finger 15 to its closed position, so the hole 40 must be rearward of the pin 36, as is shown in FIG. 3.

It will further be realized by those skilled in the art that the fingers, such as the fingers 15, should pivot out to the closed position, but should stop at a predetermined position. Also, when a bottle urges the fingers rearwardly to their open position, the fingers should stop at or before a predetermined position. To assure that the fingers stop at the preferred positions, the fingers of the present invention include a front, vertical surface 33 and a rear, angled surface 37. The bottom of the pin 36 is rounded to allow easy pivotal motion.

Thus, looking at FIGS. 3 and 7 of the drawings, it will be seen that the finger 15 will pivot freely with the rounded surface of the pin acting against the rounded bottom of the slots 34. When the finger 15 pivots to its forwardmost position, the angled surface 37 will engage the wall of the slot 34 to prevent further movement. When the finger 15 moves rearwardly to its open position, the vertical surface 33 will engage the opposite wall of the slot 34 to prevent further motion of the finger 15. Thus, the pin 36 as shown provides for the pivotal motion of the finger 15, and further provides stop means for the finger for limiting motion in each pivotal direction.

Though the finger 15 may be made of numerous different materials, it is here contemplated that the fingers will be made of a plastic material. In this event, the integrally molded pin 36 may not have sufficient strength. As a result, the finger 15 is shown as having a reinforcing pin 36A within the pin 36. Steel or other material can be used to provide the reinforcing pin 36A to give the desired strength.

It will be readily seen in FIG. 4 that, due to the location of the pivot pin 36 and the spring 38, this entire mechanism is completely protected from any debris since the entire assembly is covered by the block 14. The mechanism is therefore very secure and reliable.

It will now be understood from the foregoing that the blocks 14 would be affixed to the various bars 11 to create the desired grid. After the blocks 14 are in place, the plates 21 can be loaded with the appropriate fingers 15, and the plate 21 would then be placed against the bottom face 28 of the block 14, and a screw 24 or other fastening means would be used to hold the plate 21 against the block 14. It will also be seen from the foregoing description that, at the end of the grid 10, since there is no need for fingers on the opposite side of the bar 11, only the one or two fingers required for loading the case can be placed in the block 14 and the mechanism is completely operable, and completely secure with only the one or the two fingers installed. If there is any problem with one or more of the fingers 15, one of the screws 24 can be released to remove a single plate 21 from a single block 14, and the appropriate repairs can be made without removing the entire grid 10.

Attention is now directed to FIGS. 5 and 6 of the drawings which show an alternative form of plate to be received on the block 14. The device shown in FIGS. 5 and 6 of the drawings is designed to mount the fingers 16 as shown in FIG. 1 of the drawings, and it will here be seen that there is a plate 41 having the outside dimension and shape of the bottom face 28 of the block 14. Also, the plate 41 includes a pair of alignment pins 42 to be received within the alignment holes 31 of the block 14. As with the holes 30 and their alignment pins 29, the holes 31 and the alignment pins 42 are uniquely placed so that the block 41 must be properly aligned with the face 28 of the block 14 in order to place the plate 41 snugly against the face 28.

The plate 21 has a central hole 44 through which the screw 24 can pass, the screw 24 engaging the threaded aperture 25 as previously described in order to hold the plate 41 against the face 28 of the block 14.

It will be seen in FIG. 5 of the drawings that the plate 41 is provided with openings 45 to receive fingers 16. The openings 45 are in the form of a saw-cut because the fingers 16 are in the form of relatively thin spring steel blades. The openings 45 should have a width sufficient to receive two such fingers 16 because the arrangement shown in FIG. 1 is conventionally used when utilizing the fingers 16.

Looking at FIGS. 5 and 6 of the drawings, it will be seen that, in order to hold the fingers 16 in place with respect to the plate 41 and the block 14, the fingers 16 have a pin 46 passing therethrough, the pin 46 preferably being a snug fit within appropriate holes in the fingers 16. The plate 41 is provided with slots 48 to receive the pin 46 as in the previously described plate 21.

Looking especially at FIG. 6 in the drawings, it will be seen that the uppermost edge 49 of the fingers 16 is cut at an angle. Furthermore, the pin 46 is so located with respect to the finger 16 that, when the pin 46 is within the slot 48 of the plate 41, and the plate 41 is snugly against the face 28 of the block 14, the uppermost edge 49 of the finger 16 will be pressed firmly against the face 28 of the block 14. It will therefore be understood that, because of the angular relation of the uppermost edge 49 of the finger 16, the finger 16 will take an angular position with respect to the vertical.

As with the previously described finger 15, it will also be understood that, in FIG. 5 the various openings 45 are adapted to receive fingers 16, and fingers 16 would be placed as required in the particular grid 10. Also, at the end of the grid 10, there is no requirement to use fingers 16, or a portion thereof, in order to mount the fingers required since one or more fingers 16 may be placed in the plate 41, and the operation will be the same whether or not there are other fingers in place.

It will now be seen by those skilled in the art that the blocks 14 can be placed in a grid, and plates 21 or 41 can be placed on the blocks 14 as desired. As a result, the fingers of the type 15 or fingers of the type 16 can be used as desired in various portions of the same grid. In both the embodiments here presented, the slot 34 receives the appropriate pin 36 or 46 to hold the appropriate finger 15 or 16. The slot 34 or 48 can be deep enough to allow lateral movement of the finger if desired, as would probably be true of the finger 15, or the slot can be shallow enough to hold the finger firmly, as would be the case generally with the fingers 16.

When a grid 10 is provided with fingers made in accordance with the present invention, it will be readily seen that any one plate can be removed without removing the entire grid, or the entire set of fingers can be removed and replaced simply by removing the plates 21 or 41, still without removing the grid. It will be readily understood that a quicker form of release means may be used in lieu of the screw 24, especially if frequent changes are to be made.

It will therefore be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as defined in the appended claims.

I claim:

1. In a case loading grid, including a plurality of bars parallel to the motion of containers to be loaded, and a plurality of fingers carried by said bars for directing said containers into discrete sections of a case to be loaded, the improvement comprising a block fixed to one of said bars and having a bottom face, a plate releasably carried by said block generally contiguously with said bottom face, said plate having a configuration generally like the configuration of said bottom face, said plate defining finger receiving means for selectively receiving at least one finger of said plurality of fingers and for holding said finger adjacent to said block, said block being generally pyramidal in shape and having four sides, said block defining a bar receiving slot diagonally thereof so that two sides of said block are disposed on each side of said bar, means for retaining said bar within said bar receiving slot, the apex of said block merging into said bar, the arrangement being such that containers that engage said block will be directed to one face of said block for aligning such container with one of said discrete sections of said case, and said fingers are beneath said block within said plate for directing said container into said one of said discrete sections after said container is aligned with said one of said discrete sections.

2. In a case loading grid as claimed in claim 1, said finger receiving means comprising a finger receiving opening defined in said plate, a slot intersecting said opening, a pin transversely of said finger, the arrangement being such that said finger, is receivable within said finger receiving opening while said pin is received within said slot, said finger comprising a generally flat member having an upper end, said upper end being generally straight and angularly related to the longitudinal axis of said finger, said pin being so located as to urge said upper end against said bottom face of said block when said pin is received within said slot so that the angle between said upper end and said longitudinal axis determines the angular position of said finger with respect to said block.

3. In a case loading grid as claimed in claim 2, said finger receiving opening having a width sufficient to receive at least two of said fingers.

4. In a case loading grid including a plurality of bars parallel to the motion of containers to be loaded, and a plurality of fingers carried by said bars for directing said containers into discrete sections of a case to be loaded, each finger of said plurality of fingers being a selected one of fingers of a first type and fingers of a second type, the improvement comprising a block fixed to one of said bars and having a bottom face, a first plate releasably carried by said block generally contiguously with said bottom face, said first plate having a configuration generally like the configuration of said bottom face, said first plate defining first finger receiving means for selectively receiving at least one finger of said first type and for holding said finger of said first type adjacent to said block, said first finger receiving means including first finger receiving openings defined in the sides of said first plate, a second plate selectively carried by said block generally contiguously with said bottom face, said second plate having a configuration generally like the configuration of said bottom face, said second plate defining second finger receiving means for selectively receiving at least one finger of said second type and for holding said finger of said second type adjacent to said block, said second finger receiving means including second finger receiving openings defined at the corners of said second plate.

5. In a case loading grid as claimed in claim 4, said first plate and said second plate each further including a plurality of alignment pins extending therefrom, said block defining a plurality of alignment holes in said bottom face, said alignment pins on said first plate being located to be received within a first group of said plurality of alignment holes when said first plate is aligned with said bottom face of said block, said alignment pins on said second plate being located to be received within a second group of said plurality of alignment holes when said second plate is aligned with said bottom face of said block.

6. In a case loading grid, as claimed in claim 4, said first finger receiving means further including a slot in said first plate intersecting said first finger receiving opening, a first pin carried by said finger of said first type transversely thereof, the arrangement being such that said finger of said first type is receivable within said first finger receiving opening while said first pin is received within said slot in said first plate.

7. In a case loading grid, as claimed in claim 4, said second finger receiving means further including a slot in said second plate intersecting said second finger receiving opening, a second pin carried by said finger of said second type transversely thereof, the arrangement being such that said finger of said second type is receivable within said second finger receiving opening while said second pin is received within said slot in said second plate.

8. In a case loading grid, including a plurality of bars parallel to the motion of containers to be loaded, and a plurality of fingers carried by said bars for directing said containers into discrete sections of a case to be loaded, the improvement comprising a block fixed to one of said bars and having a bottom face, a plate releasably carried by said block generally contiguously with said bottom face, said plate having a configuration generally like the configuration of said bottom face, said plate defining finger receiving means for selectively receiving at least one finger of said plurality of fingers and for holding said finger adjacent to said block, said finger receiving means comprising a finger receiving opening defined in said plate, a slot intersecting said opening, a pin transversely of said finger, the arrangement being such that said finger is receivable within said finger receiving opening while said pin is received within said slot, said finger having a generally flat upper surface adjacent to said bottom face of said block, a spring carried by said finger and acting against said bottom face, said spring being located rearwardly of said pin for urging said finger to pivot about said pin.

9. In a case loading grid as claimed in claim 8, said pin including a front surface for engaging a first wall of said slot for limiting motion of said finger in a first pivotal direction, and a rear surface for engaging a second wall of said slot for limiting motion of said finger in a second pivotal direction.

10. In a case loading grid, including a plurality of bars parallel to the motion of containers to be loaded, a plurality of fingers carried by said bars for directing said containers into discrete sections of a case to be loaded, and means on said bars for pivotally mounting said fingers, the improvement wherein each finger of said plurality of fingers includes a pin fixed transversely thereof generally at the upper end of said finger, said pin having a rounded lower surface for allowing pivotal motion of said finger in a first direction, spring means carried by said finger for urging said finger to pivot about said pin, said pin having a first flat surface coextensive with said lower surface for limiting pivotal motion of said finger in said first direction.

11. In a case loading grid as claimed in claim 10, said pin having a second flat surface coextensive with said lower surface for limiting pivotal motion of said finger in a second direction, said second direction being opposite from said first direction.

12. In a case loading grid as claimed in claim 11, said finger defining a hole in the upper surface thereof, said hole being generally perpendicular to said pin and receiving said spring means, said spring means comprising a coil spring extending beyond said finger for acting against said means for pivotally mounting said fingers.

* * * * *